United States Patent [19]

Young

[11] 4,096,788

[45] Jun. 27, 1978

[54] APPARATUS FOR FORMING A CONTAINER SIDE WALL

[75] Inventor: Jerry W. Young, Weston, Mo.

[73] Assignee: Phillips Petroleum Company, Bartlesville, Okla.

[21] Appl. No.: 798,048

[22] Filed: May 18, 1977

[51] Int. Cl.[2] ..... B31B 1/32

[52] U.S. Cl. ..... 93/39 L; 93/39.2; 93/44.1 R; 93/81 MT

[58] Field of Search ..... 93/36.1, 39 R, 39 L, 93/39.1 R, 39.2, 39.3, 44, 44.1 R, 54 R, 54.2, 54.3, 81 R, 81 MT

[56] References Cited

U.S. PATENT DOCUMENTS

| | | | |
|---|---|---|---|
| 2,245,900 | 6/1941 | Carew | 93/36.1 |
| 2,369,205 | 2/1945 | Balton | 93/79 |
| 3,958,501 | 5/1976 | Richards | 93/39.2 |

*Primary Examiner*—Roy Lake
*Assistant Examiner*—Paul A. Bell

[57] ABSTRACT

An apparatus is provided for making a container having a tubular side wall by wrapping a blank around a mandrel to form a tubular side wall wherein a pair of wrapping wings are rotated about the axis of the mandrel by respective drive means. The drive means comprises a pair of coaxial shafts with a respective wrapping means operably connected thereto. The drive means further includes means for rotating the shafts wherein one shaft ceases rotation before the other shaft so that movement of one wing terminates before movement of the other wing whereby side marginal portions of a side wall blank can be overlapped for bonding. The drive means for rotating the shafts is such that there is a lost motion mechanism to permit the differential movement between the wings.

7 Claims, 9 Drawing Figures

APPARATUS FOR FORMING A CONTAINER SIDE WALL

There are many apparatuses known in the art for forming containers by wrapping a side wall blank around a mandrel typical of which are the two or three element clam-shell type arrangements. The use of this type of mechanism does result in some problems of which inconsistently wrapped blanks, excessive noise, complicated apparatus, inconsistent diameters of the wrapped side walls are typical. This type of mechanism has been improved upon by the use of an apparatus which utilizes a pair of wrapping wings which are driven by drive means with the wrapping wings folding a container blank about a mandrel in such a manner as to overlap side marginal portions of the blank for bonding of the marginal portions together to form a tubular side wall. Such devices are known as exemplified in U.S. Pat. No. 3,958,501.

While the last mentioned type of apparatus is effective and provides an advance in the art, the invention herein provides an alternate type of wrapping means to effect the formation of a tubular side wall. The current invention has advantages over the mentioned reference for example, the present invention operates more quietly than that disclosed in U.S. Pat. No. 3,958,501 and is easily adjustable for positioning of terminating movement of one of the wing wrappers.

The principal objects and advantages of the present invention are: to provide an apparatus for effecting wrapping of a side wall blank about a mandrel which is positive in operation; to provide such an apparatus which is relatively quiet during operation; to provide such an apparatus which is adjustable for termination of movement of one of the wrapping wings; and to provide such an apparatus which is well adapted for its intended use and inexpensive to manufacture.

Other objects and advantages of the present invention will become apparent from the following detailed description taken in connection with the accompanying drawings wherein are set forth by way of illustration and example certain embodiments of the present invention.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriate structure.

Figure 1:
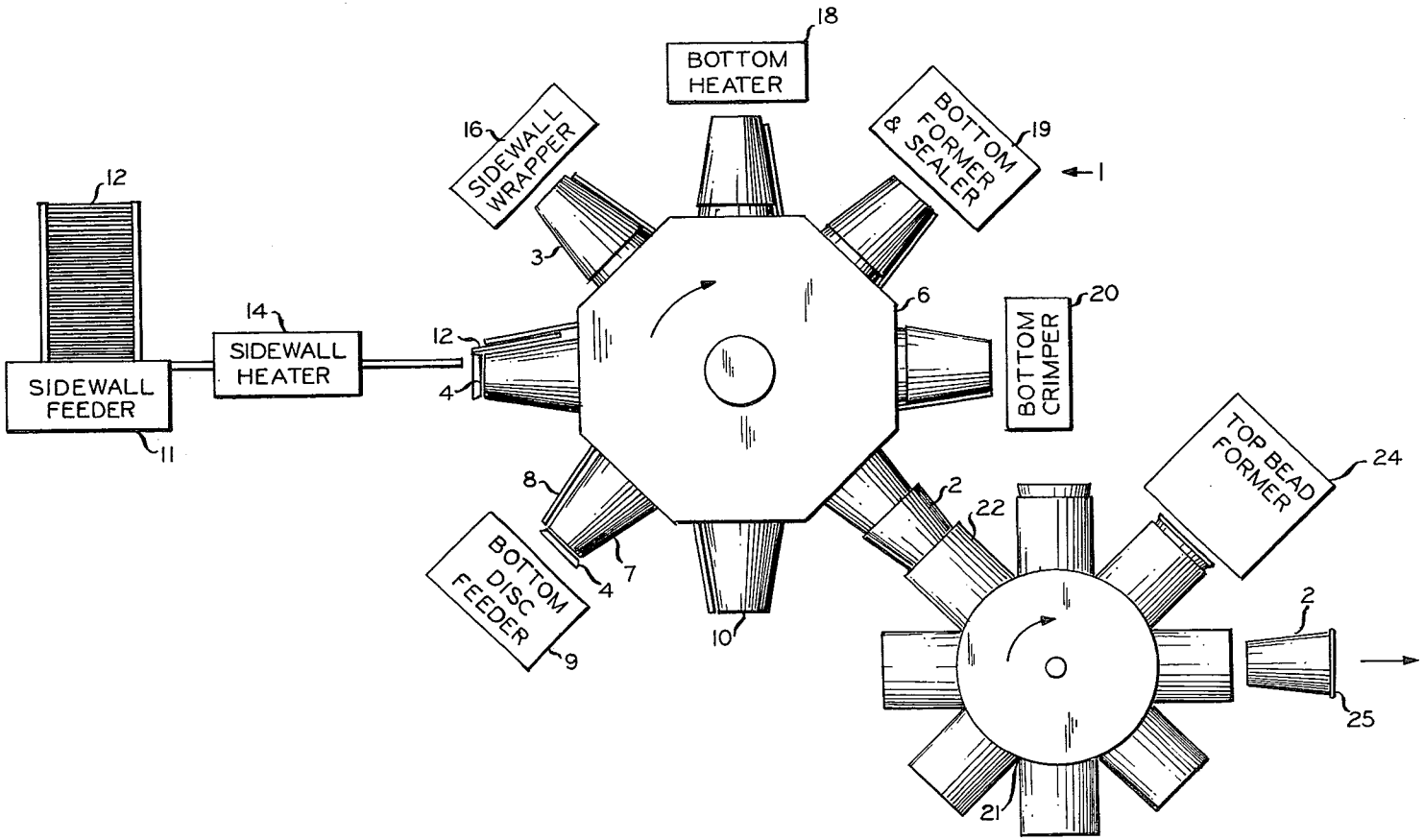
FIG. 1 is a schematic illustration of an apparatus for forming tubular containers.
Figure 2:
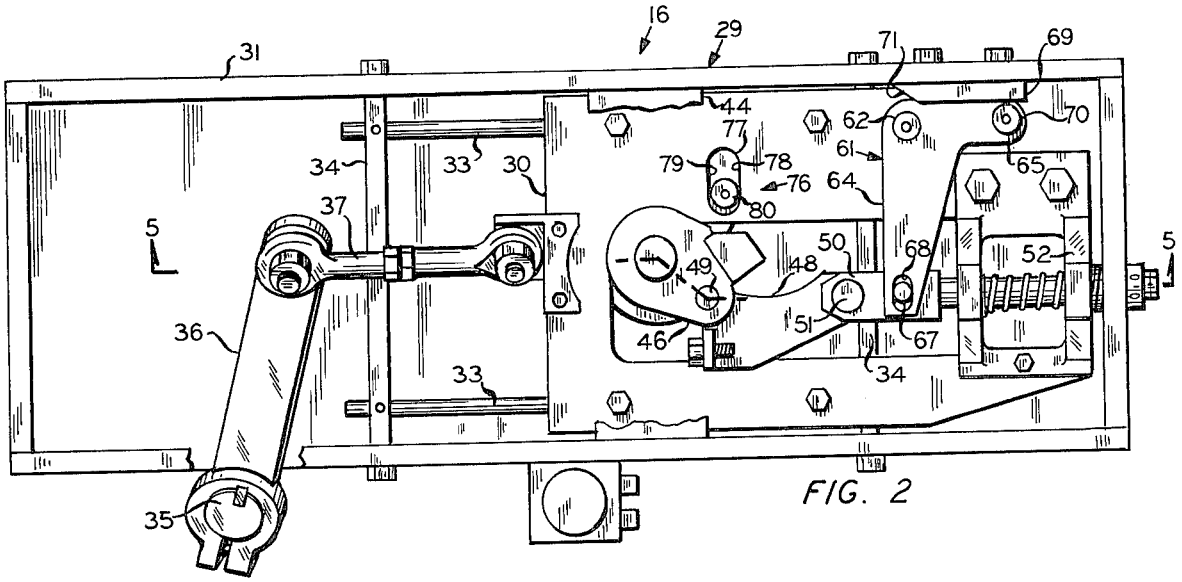
FIG. 2 is a plan view of drive means for wing wrappers with portions thereof broken away to show structural details thereof with the drive means shown in a position for starting of the wrap movement.
Figure 3:
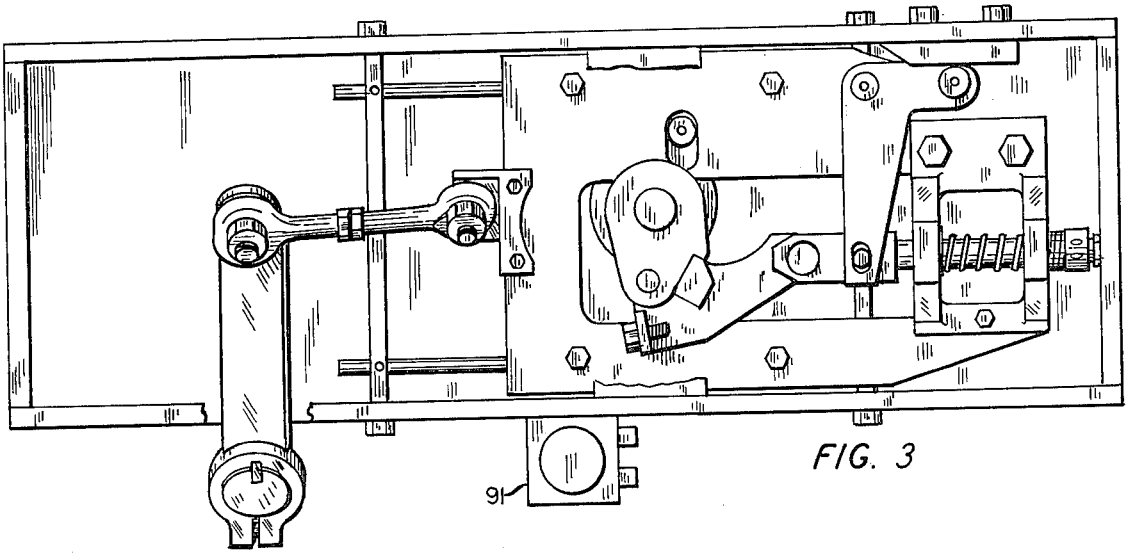
FIG. 3 is a view similar to FIG. 2 with the drive means in a position with the wing wrappers in a partially wrapped position.

Referring to FIG. 1, the reference numeral 1 designates generally an apparatus for forming containers from paperboard or the like wherein the container 2 formed by the apparatus 1 is comprised a tubular side wall 3 and a bottom member 4. The containers 2 as shown are of a tapered side wall type, however, it is to be understood that the apparatus 1 is equally applicable for forming cylindrical side wall type containers. In the form illustrated, the apparatus 1 includes a turret 6 which is rotatable about an axis which preferably is horizontal with the turret 6 having a plurality of equally spaced mandrels 7 projecting radially outwardly therefrom. The turret 6 is suitably connected to indexing drive means as is known in the art (not shown) for incremental movement of the turret to move the mandrels 7 to the various portions of the apparatus 1 for processing of blanks into finished containers. A clamp 8 is provided adjacent to each of the mandrels 7 and is suitably movable between a clamped position and an unclamped position for selectively retaining a side wall blank on a respective mandrel 7. The clamp is operable by means as is known in the art.

A bottom feeder 9 is provided and is operable for forming a bottom member 4 and depositing the formed bottom member onto a respective mandrel 7 wherein same is retained on the mandrel 7 for movement therewith in a suitable manner such as by vacuum or by being retained within a recess 10 on the bottom face of the mandrel. Bottom feeders are known in the art as for example that disclosed in U.S. Pat. No. 3,990,353. The mandrel carrying a bottom member is then moved to a position adjacent a side wall heater 14 wherein said wall feed means 11 feeds side walls 12 to the side wall heater 14 which in turn heats selected portions of the side wall blank as for example side marginal portions 15 which are to be joined together. Also, a bottom marginal portion can be heated to facilitate sealing of the bottom member 4 thereto. The heated blank 12 is fed to the waiting mandrel 7 with the side wall blank 12 being fed between the mandrel and the clamp 8 after which the clamp 8 moves to securely hold the side wall blank 12, preferably engaging an intermediate portion on outer disposed surface of the blank 12, in engagement with the respective mandrel 7. Side wall feeders and heaters are well known in the art and need not be further described in detail herein. After receiving a side wall blank 12, a mandrel 7 is then indexed to a next position or station wherein same is wrapped about the mandrel by a side wall wrapper means 16 which is more fully described hereinbelow and is operable for wrapping the side wall blank 12 about the mandrel 7 and overlapping the side marginal portions 15 for securing same together.

After the side wall 12 has been wrapped about the mandrel 7, the turret then moves another step to move the mandrel to bottom heating means 18. The bottom heating means 18 is operable for heating portions of the bottom member and a bottom portion of the side wall blank 12 so that the plastic coating thereon can be adhered together to seal the bottom of the container 2. After heating, the turret 6 is indexed again to move the mandrel 7 to bottom sealing means 19. The bottom sealing means 19 is operable for folding over a bottom marginal portion of the side wall blank 12 and urge same into engagement with a depending flange portion of the bottom member 4 urging same into engagement so that the heated portion thereof will adhere together to seal the bottom of the container 2. The bottom heater means 18 and the bottom sealing means 19 are well known in the art and need not be further described herein. Any suitable means to perform these functions can be used. After the container bottom has been sealed by the sealing means 19, the mandrel 7 is then moved to bottom crimper means 20 wherein the sealing surfaces are pressed by knurled rollers to assure that the sealing surfaces are in contact to provide a moisture proof seal, the mandrel 7 is then moved to a position for discharge of the partially completed container 2 onto a second turret 21. The discharge can be accomplished by mechanical means or in a preferred form discharge is by pneumatic pressure applied via an opening in the mandrel. The turret 21 has a plurality of container-receiving receptacles 22 thereon and they preferably are equally spaced and project radially outwardly from the turret 21. The turret 21 is mounted for rotational movement about an axis which preferably is horizontal with the turret 21 preferably rotating in the same direction as the turret 6. The turret 21 moves the partially completed container 2 to a bead-forming means 24 wherein a bead 25 is formed on the upper free edge of the container 2. After the bead has been formed, the finished container 2 is then ejected from its respective receptacle 22 such as by the use of pneumatic pressure with the container 2 being ready for use. Bead formers are well known in the art and need not be further described herein.

Figure 4:
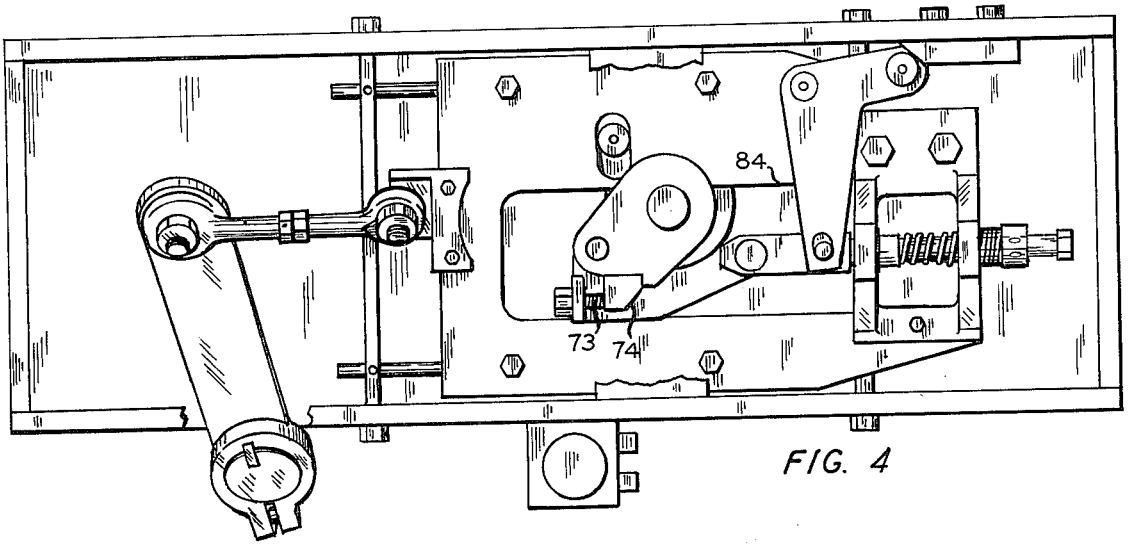
FIG. 4 is a view similar to FIGS. 2 and 3 showing the drive means in a position where the wing wrappers are in the fully wrapped position.
Figure 5:
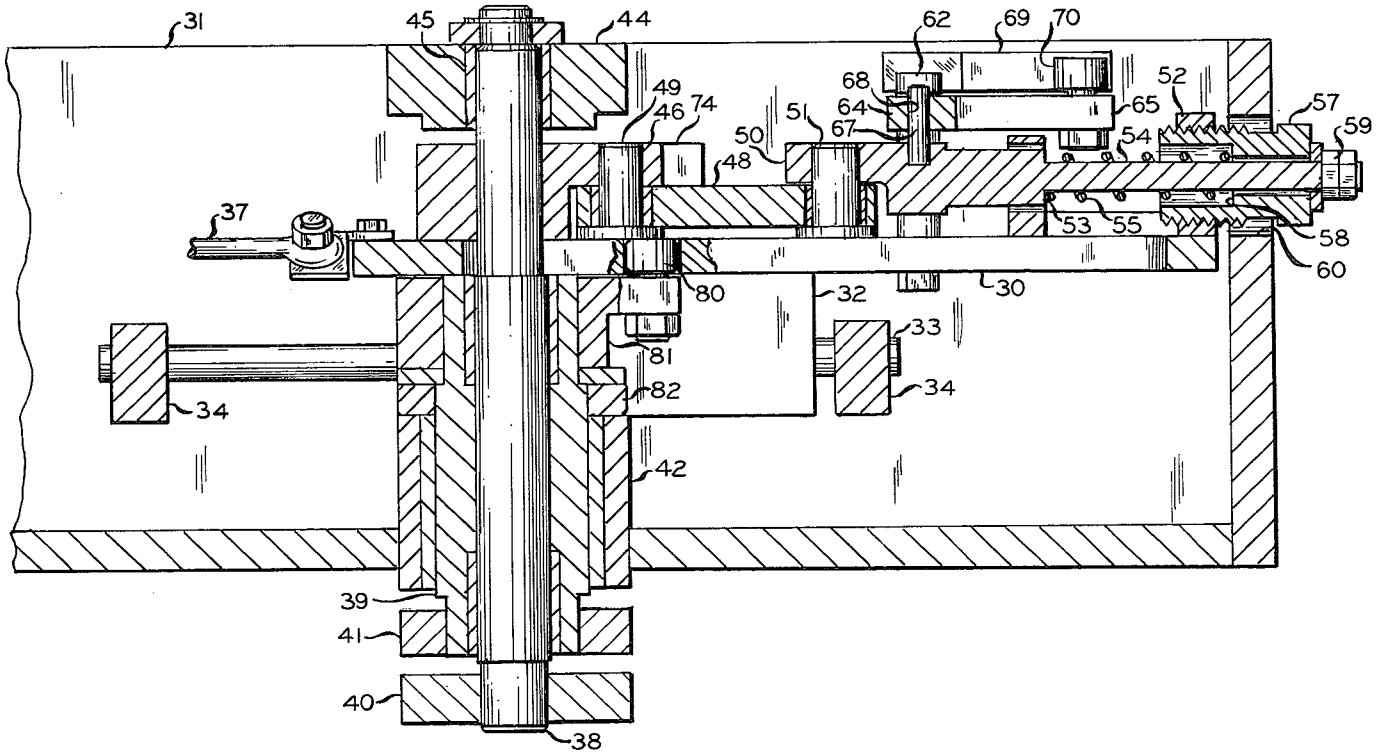
FIG. 5 is a cross-sectional view taken along the line 5—5, FIG. 2.
Figure 6:
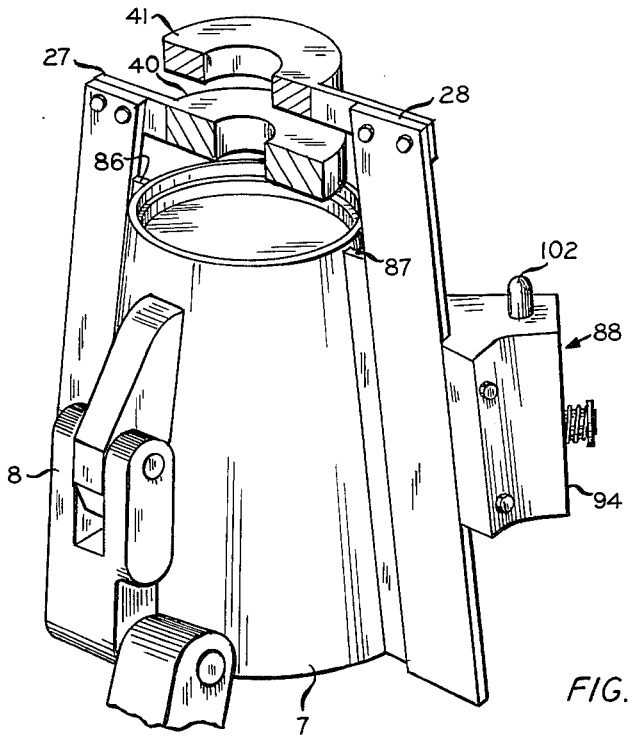
FIG. 6 is an enlarged view of a mandrel and wrapping wings which wrap a side wall blank about the mandrel.
Figure 7:
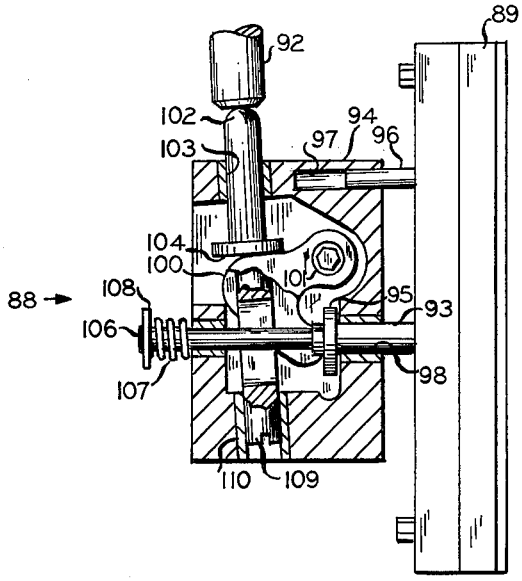
FIG. 7 is a fragmentary sectional view of means used to hold over-lapping side marginal portions of the wrapped side wall blank in engagement for sealing.

Referring to FIGS. 2 through 9, the wrapping means 16 in the illustrated structure includes a pair of wrapping wing members 27 and 28, best seen in FIG. 6, which are positioned adjacent to a mandrel 7 and are movable by drive means 29 with the drive means 29 having a lost motion mechanism whereby one of the wing wrappers substantially or completely terminates movement prior to termination of movement of the other wing wrapper so as to provide overlapping of the side marginal portions 15. The wing wrappers 27 and 28 when in a start position are positioned adjacent to and on opposite sides of the clamp 8. In the illustrated structure the drive means 29 includes a carriage 30 which is reciprocably mounted in a housing 31 such as by having bearings 32 secured to the carriage 30 with the bearings 32 being slidably mounted on guide rods 33 which are in turn suitably secured to portions of the housing 31 as for example by cross braces 34 having the guide rods 33 secured thereto and the braces 34 secured to opposite walls of the housing 31. This allows forward and retractive movement of the carriage. The carriage 30 is suitably driven by motive means such as a rotary cam operably connected to the indexing drive of the turret 6 (not shown) wherein a shaft 35 and arm 36 pivotally move with a link 37 connecting the arm 36 to the carriage 30. Movement of the carriage 30 effects movement of the wings 27 and 28 through the wrapping motions thereof with one of the wings moving further about the mandrel than the other of the wings. To accomplish this, movement of the carriage drives two, preferably coaxial, shafts 38 and 39 in forward and reverse directions with the wing 27 being suitably secured to the shaft 38 as for example by a collar 40 secured thereto. The wrapping wing 28 is suitably secured to the tubular shaft 39 as for example by a collar 41 suitably secured thereto. Preferably, the shafts 38 and 39 are coaxial with the longitudinal axis of the mandrel 7 which is positioned for having a side wall blank wrapped therearound and also, the wrapping wings 27 and 28 rotate on an axis which is generally coaxial with the longitudinal axis of the mandrel 7. As shown, the shaft 38 is rotatably sleeved within the shaft 39 and extends downwardly therefrom to allow securement of the collar 40 thereto. The shaft 39 is in turn rotatably mounted in a bearing arrangement 42 which is secured to the housing 31. An end of the shaft 38 is rotatably mounted in a brace 44 which is in turn secured to the housing 31 in any suitable manner with the shaft extending through a bearing 45.

An arm member 46 is suitably secured to the shaft 38 adjacent an upper end thereof as seen in FIG. 5 and has pivotally connected thereto a linkage means or arrangement which operably connects the shaft 38 to the carriage whereby movement of the carriage effects rotation of the shaft 38 a preselected amount of the termination of which the carriage can continue forward movement. As shown, the linkage means is comprised of a first link 48 which is pivotally connected to the arm 46 as at 49 and the other end of the link 48 is pivotally secured to a second link member 50 as at 51. Preferably, the link 50 is slidably mounted in a bearing bracket 52 for forward and retractive reciprocal movement of the link 50 relative to the carriage 30 in a generally linear path which is generally parallel or in line with the longitudinal axis of the link 50. The bracket 52 is in turn suitably secured to the carriage 30 or it is to be noted that the bracket 52 can be an integral part of the carrige 30 and can be considered a part thereof. The link 50 has a shoulder 53 and a round shaft portion 54 which has received thereon a resilient member 55 such as a coil spring with one end of the spring abutting the shoulder 53. A shoulder-forming member 57 is suitably secured to the bracket 52 as for example by being in threaded engagement therewith and has therein a shoulder 58 which is engageable with the other end of the spring 55 whereby movement of the link 50 relative to the bracket 52 causes extension and contraction of the spring 55 in relation to the relative movement of the link 50 to the bracket 52. To prevent excessive movement of the link 50 stop members 59 are secured to an end thereof which extends through the member 57 as for example the stops 59 can be nuts which are in threaded engagement with a threaded end portion of the shaft 54. This maintains a predetermined amount of compression on the spring 55. The member 57 as shown is selectively movable through an opening 60 in an end wall of the housing 31 in response to movement of the carriage 30 between its forward and retractive positions wherein in the retracted position the member 57 extends through the opening 60. This provides clearance and ease of maintenance on the member 57 and the stops 59.

A lost motion mechanism is provided and includes the linkage arrangement comprised of the links 48 and 50 and as shown the lost motion mechanism also includes a generally L-shaped arm 61 which is pivotally mounted on the carriage 30 as for example by a suitable pivot 62 and is movable therewith. The arm 61 has two arm portions 64 and 65. The arm portion 64 is suitably operably connected to the link arrangement and preferably is operably connected to the link 50 in a pivotal manner as for example by having a pivot pin 67 secured to the link 50 and being received in an elongate slot 68 to provide relative movement between the arm 61 and the link 50. The lost motion mechanism also includes means for selectively preventing pivotal movement of the arm 61 and as shown a cam arrangement is provided wherein a cam and follower cooperate with the arm 61 to prevent pivoting movement thereof until a preselected position of the carriage 30. As shown, a cam 69 is secured to a wall of the housing 31 and a roller follower 70 is secured to the arm portion 65 and normally is in engagement with the cam 69. During forward movement of the carriage 30 which is to the left in FIGS. 2, 3 and 4, the roller 70 maintains contact with the cam 69 and by virtue of the three points of contact of the arm 61, i.e., with the pin 67, pivot 62 and roller 70, the arm 61 is prevented from pivoting on the carriage 30. As best seen in FIG. 4, when the roller 70 passes over an inclined portion 71 of the cam which is inclined away from the direction of travel of the carriage 30, the arm 61 is free to pivot. The roller 70 moves onto the inclined portion 71 at about the instant that a stop member 73 which is secured to the link 48 engages a stop 74 which is secured to the arm 46. This makes the linkage arrangement of the links 48 and 50 rigid whereby further forward movement of the carriage 30 moves the carriage 30 against the spring 55 with the arm 46 and shaft 38 being substantially or completely held against further movement and rotation. Preferably, the stop 73 is adjustable as for example same can be a screw in threaded engagement with a portion of the link 48. The slot 68 is elongate so that during further forward movement of the carriage 30 after termination of movement of the arm 46 and the roller 70 moves onto the inclined portion 71, the arm 61 can continue to move with the carriage because the distance between the pivot 62 and the pivot pin 67 can be extended.

The shaft 39 is also driven by movement of the carriage 30 and as shown cam means 76 is provided whereby forward and retractive movement of the carriage effects forward and reverse rotation of the shaft 39. The cam means as illustrated include a slot 77 which has its longitudinal axis generally normal to the direction of movement of the carriage 30 and has surfaces 78 and 79 which are engageable with a roller follower 80 with the roller 80 being suitably mounted on an arm 81 which is suitably secured to the shaft 39 for effecting rotation thereof. During forward movement of the carriage 30 the surface 78 is in engagement with the follower 80 causing counter-clockwise movement of the shaft 39 as viewed in FIG. 2 and retractive movement of the carriage 30 effects contact between the surface 79 and the roller 80 which in turn effects clockwise movement of the shaft 39 to return the wing 28 back to its initial start position. Movement of the arm 81 and hence rotation of the shaft 39, is accomplished throughout substantially the entirety of the forward and retractive movements of the carriage 30. Rotations of the shafts 38 and 39 are in opposite directions and simultaneous whereby the wings 27 and 28 move in opposite rotational directions about the longitudinal axis of the mandrel 7. Forward rotation of the wing wrappers 27 and 28 effects wrapping of the side wall blank and reverse rotation moves the wing wrappers 27 and 28 back to a start position. Preferably, a thrust bearing arrangement 82 is provided to reduce friction between the arm 81 and the bearing arrangement 42 which is due to longitudinal loading of the shaft 39. Preferably, the carriage 30 has an opening 84 through which the shaft 38 extends with the opening 84 being elongate in the direction of movement of the carriage 30 to provide clearance for forward and retractive movement of the carriage 30.

In the illustrated structure, the wings 27 and 28 extend generally longitudinally along the mandrel 7 and have mounted thereon wiping blades 86 and 87, respectively, which are spring-loaded to an extended position for contact with the side wall blank 12. The wiping edges of the wipers 86 and 87 are generally parallel to the surface of the mandrel 7 about which the blank 12 is wrapped. By virtue of the fact that the wrapping wing 27 which is secured to the shaft 38 ceases movement prior to termination of movement of the wing 28 overlapping of side wall marginal portions of the blank 12 can be effected by further movement of the wing 28 after termination of movement of the wing 27. Means 88 is provided to urge the overlapping marginal portions into engagement and retain them in engagement until bonding or sealing can be effected therebetween. The side wall blank 12 preferably is coated with a thermoplastic material which by being heated by the side wall heater 14 effects the bonding under pressure. In the illustrated structure, the means 88 includes a clamp member 89 which is movable into engagement with the exterior overlapping side marginal portion 15 after termination of movement of the wrapping wings 27 and 28. In the form shown, means 88 is operable for selectively moving the clamp 89 from an extended position to a retracted position and preferably this portion of the means 88 is carried by the wrapping wing 28 and movable therewith. As shown, the means includes an actuator 91 such as a pneumatic ram which is secured to the housing 31. The movable rod portion 92 thereof is selectively operable for allowing movement of the clamp 89 between forward and retracted positions. The clamp 89 is carried by a shaft 93 which is reciprocally mounted in a housing 94 with the shaft 93 having means to limit forward movement such as a shoulder-forming head 95. A guide pin 96 is also secured to the clamp 89 and is movable within a bore 97 to prevent rotation of the clamp 89 by rotation of shaft 93 in the bearing 98. To change downward movement of the rod 92 into forward movement of the clamp 89 there is provided a generally L-shaped arm 100 which is pivotally mounted within the housing 94 as at 101 and an actuator rod 102 is reciprocally mounted in a bearing 103 which is mounted in the housing 94. An end portion 104 is engageable with one leg of the arm 100 to urge same to pivot about the pivot 101 wherein the other leg of the arm 100 is engageable with the head 95 whereby during pivoting of the arm 100 by extension of the pneumatic ram 91 the clamp 89 moves to its forward position. Resilient means is provided to retain the clamp 89 in its retracted position and as shown, a rod 106 is operably connected to the shaft 93 and is biased to return the clamp 89 to its retractive position by a resilient member 107 such as a coil spring. This spring is positioned between a head 108 on the rod 106 and a portion of the housing 94. The arm 100 can have a slot therethrough to provide clearance for the rod 106. Also, the rod 102 can have an end portion 109 slidably received in a bearing 110 mounted in the housing 94 to provide good bearing support for the rod 102 during movement thereof. When the pneumatic ram is retracted, the spring 107 moves the rod 102 and the arm 100 upwardly as viewed in FIG. 7 thereby returning the clamp 89 to its retracted position.

Figure 8:
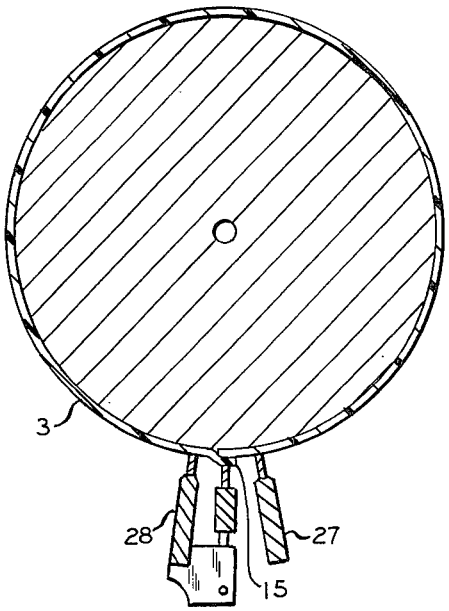
FIG. 8 is a fragmentary end view of a mandrel shown schematically with the wrapping wings shown in the fully wrapped position.
Figure 9:
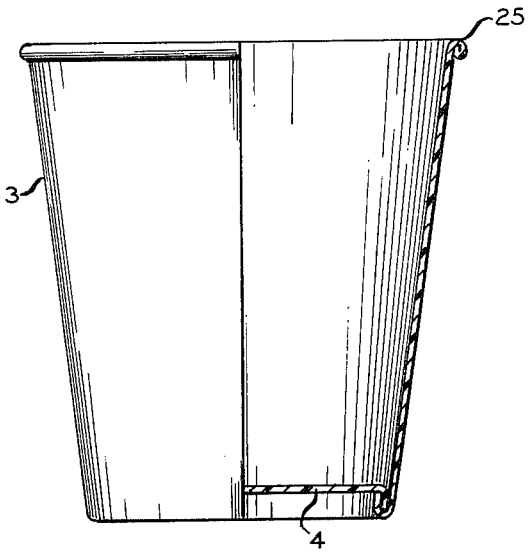
FIG. 9 is an elevation view of a container with sections broken away to show structural details thereof.

As best seen in FIG. 8, forward movement of the carriage 30 moves the wrapping wing 27 to its terminal forward position adjacent the overlap side marginal portions after which the wrapping wing 28 can be moved to its terminal position by further forward movement of the carriage 30, wherein the clamp 89 is in alignment with the overlapped marginal portions whereby forward movement of same urges the overlapped marginal portions 15 into engagement with one another to effect adhesion therebetween.

It is to be understood that while I have illustrated and described certain forms of my invention, it is not to be limited to the specific form or arrangement of parts herein described and shown.

What is claimed and desired to be secured by letters patent is:

1. An apparatus for making a container by wrapping a blank around a mandrel to form a tubular side wall for a container, said apparatus including:

(a) a mandrel;

(b) clamp means cooperating with said mandrel for holding a portion of a blank in engagement with said mandrel;

(c) first and second wing means positioned for contact with an outer disposed surface of the held blank on opposite sides of the clamp means;

(d) first means operably connected to said first and second wing means for rotating said first and second wing means about the axis of the mandrel for wrapping the held blank around the mandrel and for terminating rotation of the first wing means around the axis before opposite side margins of the blank are overlapped by continuing rotation of the second wing means around the axis, said first means including:

(1) a carriage;

(2) guide means for movably supporting said carriage;

(3) drive means operably connected to said carriage for effecting reciprocating movement thereof in forward and retractive directions;

(4) first and second shaft means each carrying one of said first and second wing means, respectively;

(5) first and second arms each connected to one of said first and second shafts, respectively, said second arm having a first cam follower thereon;

(6) first cam means carried by said carriage and cooperating with said first cam follower whereby movement of said carriage effects movement of said second arm and thereby rotation of said second shaft and the second wing means;

(7) a third arm pivotally mounted on said carriage and movable therewith;

(8) a linkage means operably connecting said third arm to said first arm whereby movement of said carriage effects movement of said first arm and thereby rotation of said first shaft and the first wing means; and (9) stop means cooperating with said first arm for substantially stopping movement thereof during forward movement of said carriage and thereby substantially stopping movement of the first wing means;

(10) second means cooperating with said third arm for selectively preventing pivotal movement thereof until said carriage nears the end of the forward movement whereby upon pivotal movement of said third arm said carriage can continue forward movement after said first arm has stopped moving to effect further movement of said second arm and said second wing means; and (e) third means operable for urging the overlapped side margins into engagement with one another and effect securing same together to form a tubular side wall.

2. The apparatus as set forth in claim 1 wherein said linkage means includes:

(a) a first link pivotally connected to the first arm;

(b) a second link pivotally connected to said first link and movably mounted on said carriage for reciprocal movement relative to said carriage between first and second positions;

(c) resilient means biasing said second link to its first position; and (d) said stop means cooperating with said first arm and said first link whereby at a predetermined position of said first arm during forward movement of said carriage pivoting movement of said first link relative to the first arm is prevented during further forward movement of said carriage.

3. The apparatus as set forth in claim 2 wherein said second means includes:

(a) a second cam and a second follower which cooperate with said third arm, one of said second cam and said second follower is carried by the third arm and movable therewith relative to the other of said second cam and said second follower whereby about when said stop means prevents relative movement between said first link and said first arm said second follower moves onto a portion of said second cam which allows said third arm to pivot permitting further forward movement of the carriage with no further rotation of the first wing means.

4. The apparatus as set forth in claim 3 wherein:

(a) said third arm is pivotally connected to said second link by fourth means which permits extension of the distance between the pivotal connection of the third arm to the second link and the pivotal mounting of the third arm to the carriage.

5. The apparatus as set forth in claim 4 wherein:

(a) said fourth means includes an elongate slot in one of said third arm and said second link and a pivot pin received in said slot and secured to the other of said third arm and said second link.

6. The apparatus as set forth in claim 4 wherein:

(a) said first cam means includes an elongate slot in said carriage with certain surfaces defining same engageable with said first cam follower.

7. The apparatus as set forth in claim 4 including:

(a) bearing means secured to said carriage with said second link being slidably mounted therein for axial reciprocal movement relative to said carriage.

* * * * *